US008360488B2

(12) United States Patent
Forrest et al.

(10) Patent No.: US 8,360,488 B2
(45) Date of Patent: Jan. 29, 2013

(54) REMOVABLE PULL COVER

(75) Inventors: Earl David Forrest, Asheboro, NC (US); Andrew James Graff, Greensboro, NC (US)

(73) Assignee: Liberty Hardware Mfg. Corp., Winston-Salem, NC (US)

( * ) Notice: Subject to any disclaimer, the term of this patent is extended or adjusted under 35 U.S.C. 154(b) by 1132 days.

(21) Appl. No.: 12/098,542

(22) Filed: Apr. 7, 2008

(65) Prior Publication Data

US 2009/0250948 A1 Oct. 8, 2009

(51) Int. Cl.
*E05C 19/10* (2006.01)

(52) U.S. Cl. ..... 292/348; 292/355; 292/251.5

(58) Field of Classification Search ..... 292/348–353, 292/355 X, 356, 251.5
See application file for complete search history.

(56) References Cited

U.S. PATENT DOCUMENTS

| | | | | |
|---|---|---|---|---|
| 159,509 | A | | 2/1875 | Haines |
| 511,186 | A | | 12/1893 | Ball |
| 600,849 | A | | 3/1898 | Brown |
| 1,319,893 | A | | 10/1919 | Mueller |
| 1,848,526 | A | | 6/1930 | Heerwagen |
| 1,974,682 | A | | 5/1934 | Margoshes |
| 1,993,938 | A | | 3/1935 | McDonald |
| 3,024,555 | A | | 3/1962 | Abeles |
| 3,096,115 | A | | 7/1963 | Patriquin |
| 3,313,057 | A | | 4/1967 | Leddy |
| 3,340,377 | A | | 9/1967 | Okazaki |
| 3,543,329 | A | | 12/1970 | Gulette et al. |
| 4,099,755 | A | * | 7/1978 | Anderson ..... 292/251.5 |
| 4,223,799 | A | * | 9/1980 | Eyster et al. ..... 220/230 |
| 4,310,978 | A | | 1/1982 | Stern |
| H46 | H | | 4/1986 | Gladden |
| 4,580,742 | A | * | 4/1986 | Moosberg et al. ..... 242/288 |
| 4,766,642 | A | | 8/1988 | Gaffney et al. |
| 5,305,999 | A | | 4/1994 | Tate |
| 5,469,758 | A | | 11/1995 | Howie, Jr. |
| 5,499,427 | A | | 3/1996 | Bowman |
| 5,740,557 | A | | 4/1998 | Reid et al. |
| 5,931,058 | A | | 8/1999 | Ran |
| 6,022,280 | A | | 2/2000 | Arenburg et al. |
| 6,131,247 | A | * | 10/2000 | Morita ..... 24/303 |
| 6,153,279 | A | | 11/2000 | Charley |
| 6,190,026 | B1 | | 2/2001 | Moore |
| 6,242,064 | B1 | | 6/2001 | Howie, Jr. |
| 6,295,702 | B1 | * | 10/2001 | Bauer ..... 24/303 |
| 6,463,630 | B1 | | 10/2002 | Howie, Jr. |
| 6,957,926 | B2 | * | 10/2005 | Okuda ..... 403/374.3 |
| 6,978,521 | B2 | * | 12/2005 | Morita ..... 24/303 |
| 2004/0078933 | A1 | | 4/2004 | Forrest |
| 2008/0252086 | A1 | * | 10/2008 | Houis ..... 292/348 |
| 2010/0308605 | A1 | * | 12/2010 | Fiedler ..... 292/251.5 |

* cited by examiner

*Primary Examiner* — Carlos Lugo
*Assistant Examiner* — Mark Williams
(74) *Attorney, Agent, or Firm* — Carlson, Gaskey & Olds PC

(57) ABSTRACT

An example pull assembly includes a knob that defines an axis and a cover moveable between an installed position adjacent the knob and an uninstalled position further from the knob than the installed position. A magnet holds the cover in the installed position. A cam extends from the cover, the knob, or both. The cam urges the cover from the installed position to the uninstalled position when the cover is rotated relative the knob about the axis.

11 Claims, 8 Drawing Sheets

REMOVABLE PULL COVER

BACKGROUND OF THE INVENTION

Pulls for opening drawers and doors are known. Example pulls include knobs and handles. Kitchens, bathrooms, and other environments often include pulls for repositioning cabinet doors. A user grasps the pull with their hand and, using the pull, moves the door to a desired position. The pull provides a hand-hold for repositioning the door. The pull may help the user pull a drawer open or push a drawer closed, for example.

Pulls can aesthetically enhance their surrounding environments. As an example, some decorative pulls include intricate details and accents. Such decorative pulls are especially common in household environments. Incorporating more decorative pulls into a new kitchen design enhances or changes the new kitchen's aesthetic appeal, for example. Similarly, replacing pulls in an existing kitchen with newer pulls can update the look of the kitchen, the kitchen's theme, or otherwise change the kitchen aesthetics.

Pulls typically secure to doors or drawer faces with one or more screws. Replacing entire pulls is expensive and requires tools for removing the screws. Replacing a portion of a pull with a tool can mar or damage other portions of the pull.

SUMMARY

An example pull assembly includes a knob that defines an axis and a cover moveable between an installed position adjacent the knob and an uninstalled position further from the knob than the installed position. A magnet holds the cover in the installed position. A cam extends from the cover, the knob, or both. The cam urges the cover from the installed position to the uninstalled position when the cover is rotated relative to the knob about the axis.

An example cover assembly for a cabinet pull includes a cover that defines an axis and a metallic portion of the cover. The metallic portion is attractable to a magnet restrained within a cabinet knob. Rotating the cover about the axis relative the cabinet knob axially moves the metallic portion away from the magnet.

An example method of removing a cover from a pull assembly includes holding a cover in an installed position against a knob using a magnet, rotating the cover relative to the knob about an axis, and moving the cover along the axis to an uninstalled position using a cam. The uninstalled position is further from the knob than the installed position.

These and other features of the present invention can be best understood from the following specification and drawings, the following of which is a brief description.

DETAILED DESCRIPTION OF THE PREFERRED EMBODIMENT

Figure 1:
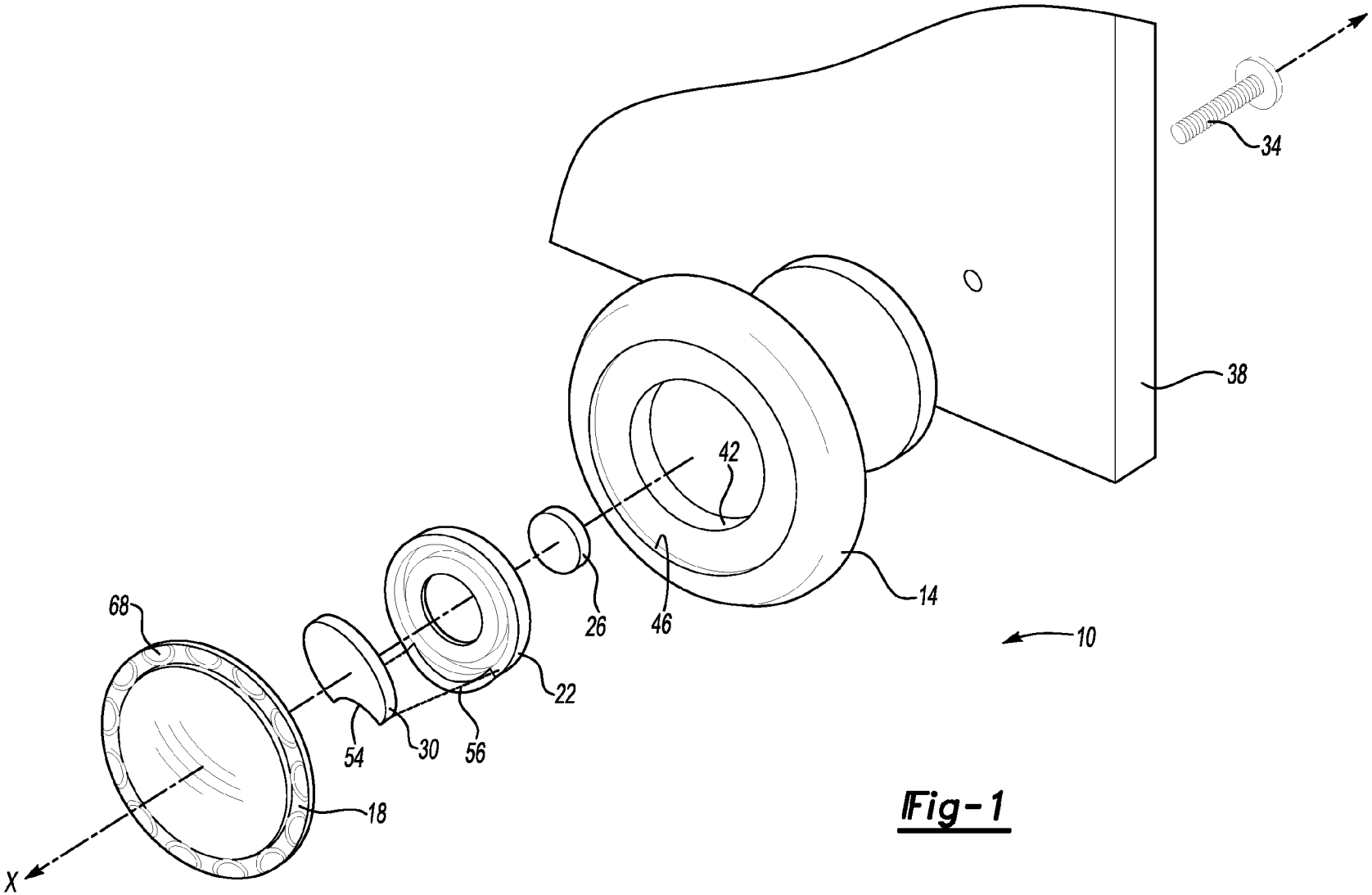
FIG. 1 shows an exploded view of an example pull assembly.

Referring to the exploded view of FIG. 1, an example pull assembly 10 includes a knob 14 and a cover 18. A knob insert 22 secures a magnet 26 relative the knob 14. A metallic plate 30 secured to the cover 18 is attractable to the magnet 26. The pull assembly 10 generally defines an axis X.

Figure 2:
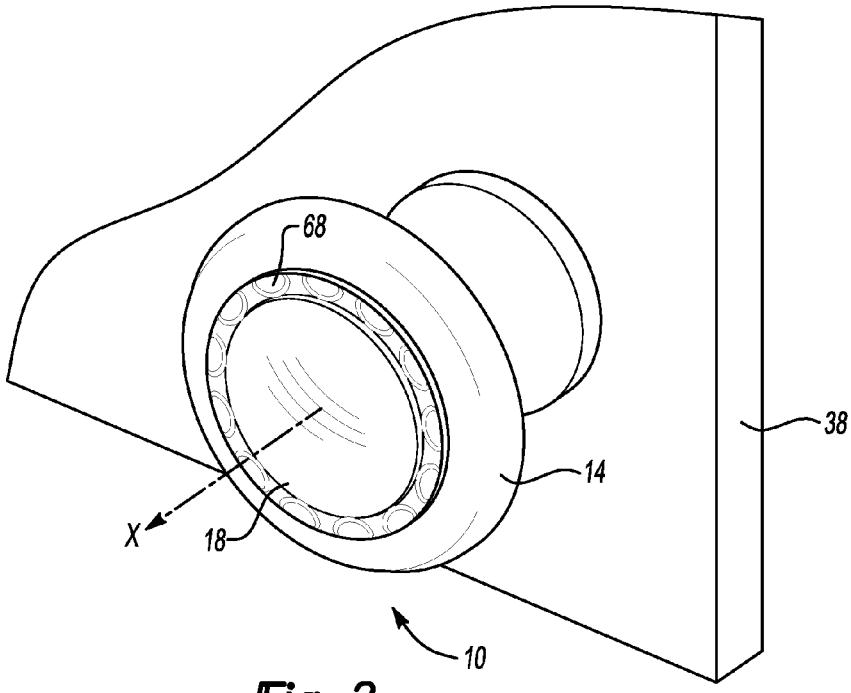
FIG. 2 shows a view of the FIG. 1 pull assembly in an installed position.
Figure 3:
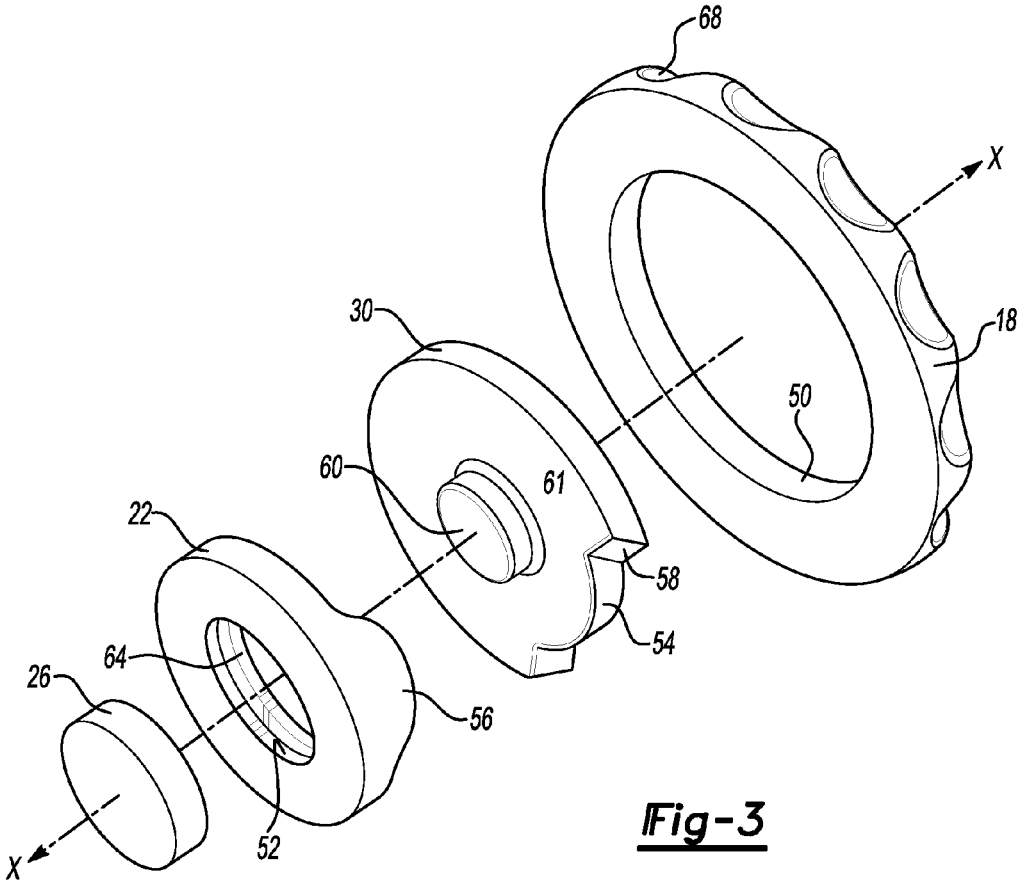
FIG. 3 shows another exploded view of portions of the FIG. 1 pull assembly.

Referring now to FIGS. 2 and 3 with continuing reference to FIG. 1, a screw 34 may be used to secure the example knob 14 to a cabinet door 38 when the pull assembly 10 is in an installed position as shown in FIG. 2. Tightening the screw 34 limits relative movement between the knob 14 of the pull assembly 10 and the cabinet door 38.

When the pull assembly 10 is in an installed position, the knob 14 receives the knob insert 22 within a first recessed area 42. In this example, the diameter of the knob insert 22, relative the axis X, is slightly larger than the diameter of the first recessed area 42. The knob insert 22 is also made from a softer material than the knob 14. For example, the knob insert 22 comprises a polymer material, and the knob 14 comprises a harder material, such as wood. When the knob insert 22 is received within the first recessed area 42, the knob 14 holds the position of the knob insert 22 due to the interference fit between the radially outer radial edges of the knob insert 22 and the portions of the knob 14 defining the first recessed area 42. Simply put, the harder knob 14 slightly deforms the softer knob insert 22 to hold the position of the knob insert 22 relative the knob 14.

Because the magnet 26 is positioned between the knob insert 22 and the knob 14, holding the position of the knob insert 22 relative the knob 14 limits movement of the magnet 26 away from the knob 14. Other examples may include incorporating the knob insert 22 as a portion of the knob. Such examples may include securing the magnet 26 directly to the knob 14.

The example knob 14 also includes a second recessed area 46 extending radially further from the axis X than the first recessed area 42. The second recessed area 46 receives the cover 18 within the pull assembly 10 and facilitates coaxially aligning the cover 18 with the knob 14 when the pull assembly 10 is in the installed position. That is, the portions of the knob 14 defining the second recessed area 46 guide the cover 18 into a position axially aligned with the knob 14 in the installed position. As shown in FIG. 2, the second recessed area 46 also facilitates hiding the portions of the radially outer edge of the cover 18 when the pull assembly 10 is in the installed position.

The cover 18 includes a third recessed area 50 for receiving the metallic plate 30, which, in this example, is adhesively secured to the cover 18. Securing the metallic plate 30 to the cover 18 ensures that the cover 18 draws toward the magnet 26 with the metallic plate 30. In this example, the cover 18 is a polymer material, and not magnetically attractable, which necessitates adding the metallic plate 30. Other example covers are made of metallic material or are otherwise attractable to the magnet 26 without the metallic plate 30. The metallic plate 30 may not be necessary in such examples.

Figure 4A:
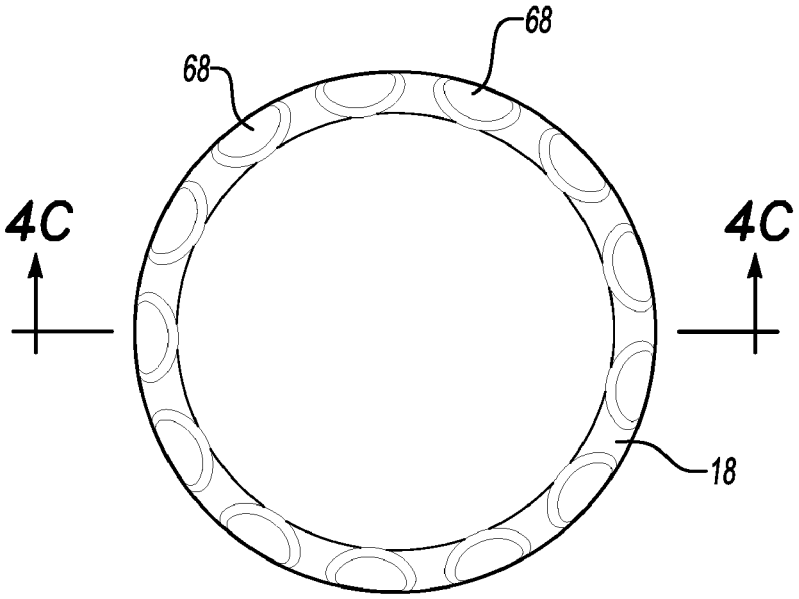
FIG. 4A shows a top view of the cover in the FIG. 1 assembly.
Figure 4B:
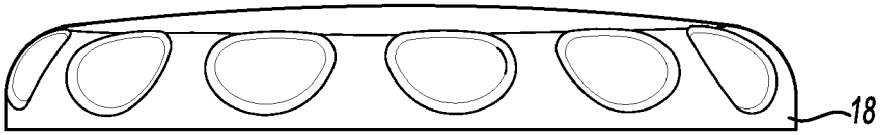
FIG. 4B shows a side view of the FIG. 4A cover.
Figure 4C:
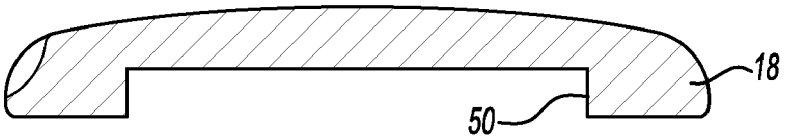
FIG. 4C shows a sectional view through line 4C-4C of the FIG. 4A cover.

FIGS. 4A-4C show various views of the cover 18. In this example, the cover 18 includes a plurality of divots 68 arranged about the perimeter portions of the cover 18. The divots 68 aesthetically enhance the cover 18. Other example covers may include aesthetic enhancements, such as different materials, colors, designs, geometries, etc. In one specific example, the user replaces the cover 18 with another cover having a holiday design. Those skilled in the art and having the benefit of this disclosure will understand that several additional types of covers are possible and would fall within the scope of this disclosure.

Figure 5A:
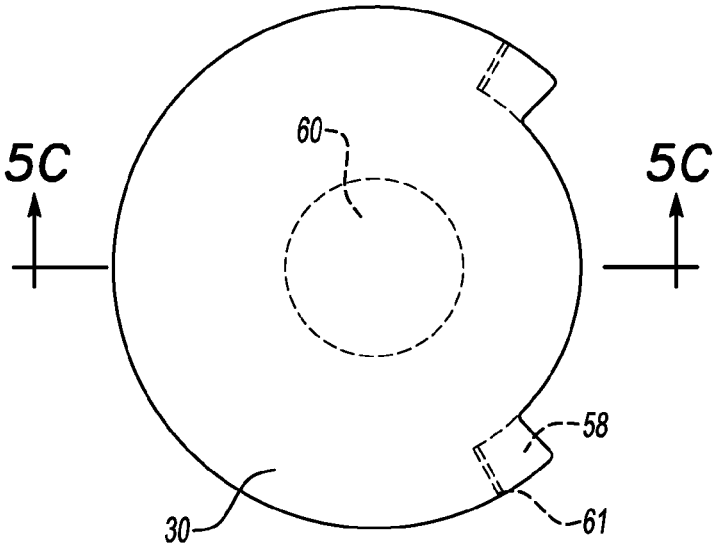
FIG. 5A shows a top view of the plate in the FIG. 1 assembly.
Figure 5B:
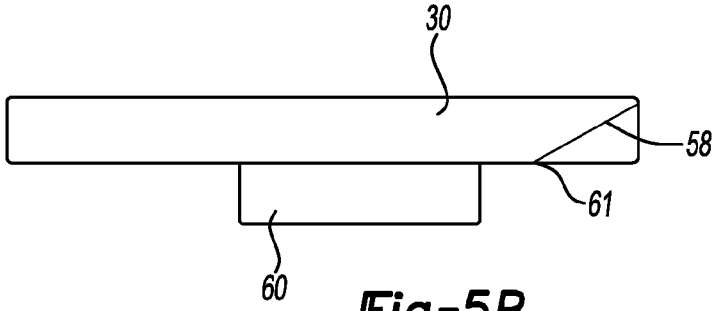
FIG. 5B shows a side view of the FIG. 5A plate.
Figure 5C:
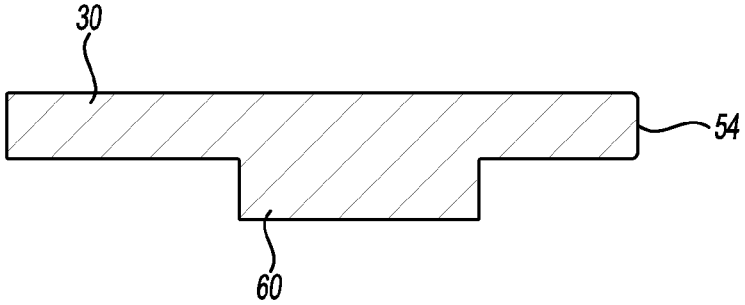
FIG. 5C shows a sectional view through line 5C-5C of the FIG. 5A plate.
Figure 6A:
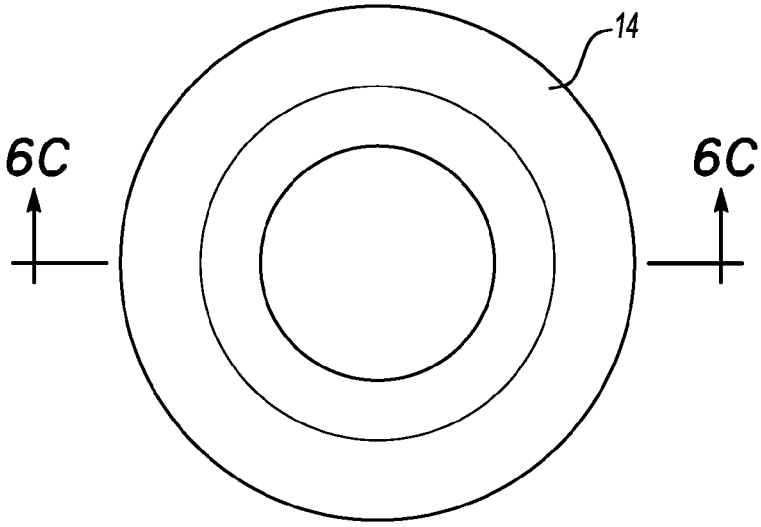
FIG. 6A shows a top view of the knob in the FIG. 1 assembly.
Figure 6B:
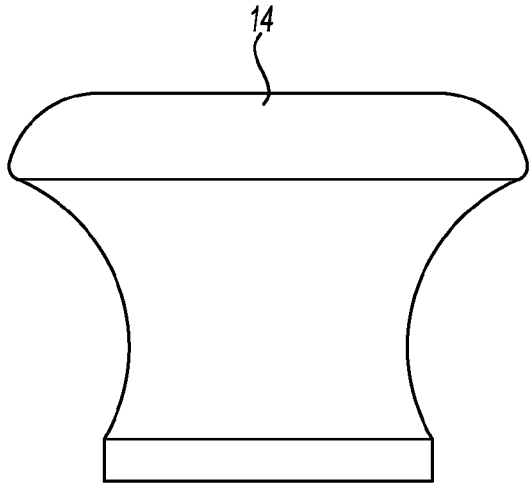
FIG. 6B shows a side view of the FIG. 6A knob.
Figure 6C:
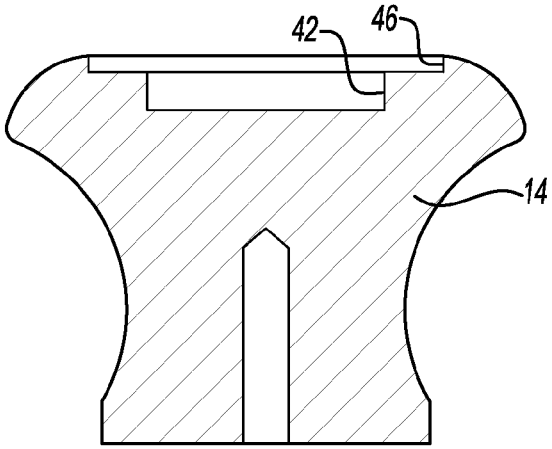
FIG. 6C shows a sectional view through line 6C-6C of the FIG. 6A knob.
Figure 7A:
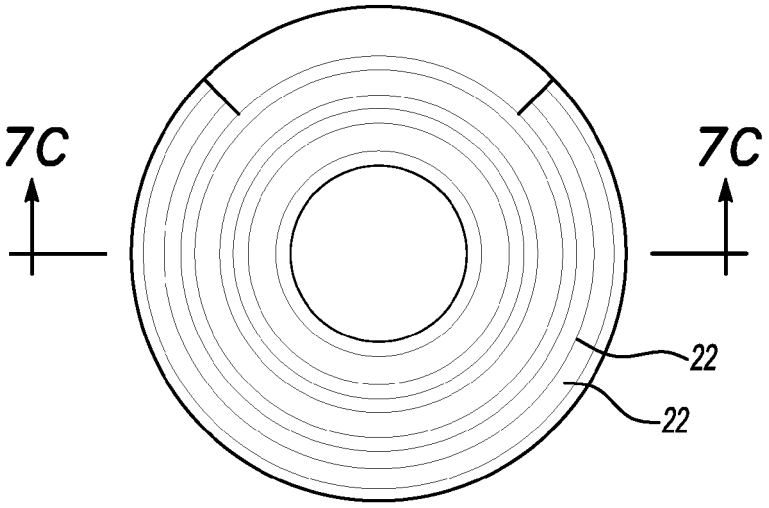
FIG. 7A shows a top view of the knob insert in the FIG. 1 assembly.
Figure 7B:
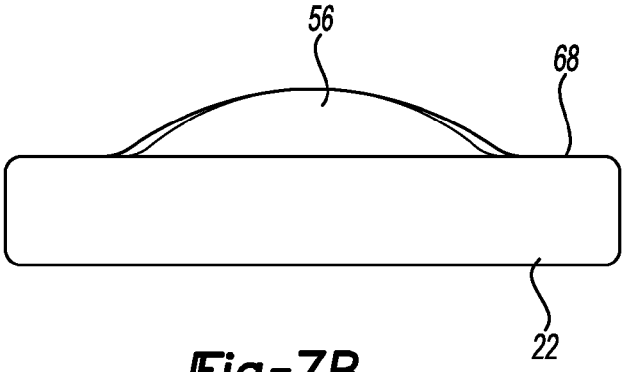
FIG. 7B shows a side view of the FIG. 7A knob insert.
Figure 7C:
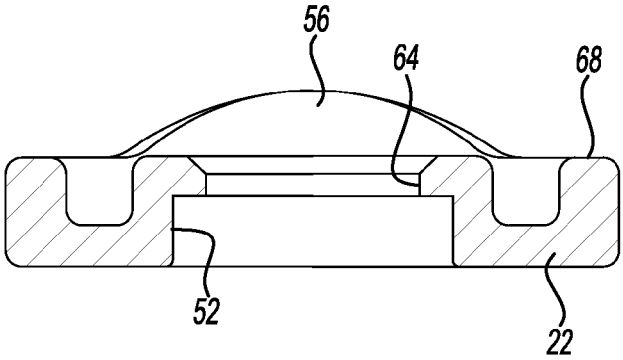
FIG. 7C shows a sectional view through line 7C-7C of the FIG. 7A knob insert.

Referring to FIGS. 5A-5C, the example metallic plate 30 includes a notch 54 for receiving a cam 56 extending from the knob insert 22. The notch 54 receives the cam 56 when the pull assembly 10 is in the installed position (FIG. 2). A ramp area 58 of the metallic plate 30 at least partially defines the notch 54. The ramp area 58 facilitates movement of the notch 54 over the cam 56 of the knob insert 22 (FIG. 1), as will be described below in additional detail. In this example, a portion of the ramp area 58 is radiused at 61 to facilitate initiating movement of the ramp area 58 over the cam 56. Other examples may include a larger radiused area in place of the ramp area 58.

FIGS. 6A-7C show additional views of the knob 14 and the knob insert 22, and illustrate the depth differences between the first recessed area 42 and the second recessed area 46 in the knob 14. The knob insert 22 includes a forth recessed area 52 for receiving the magnet 26 (FIG. 1).

Figure 8A:
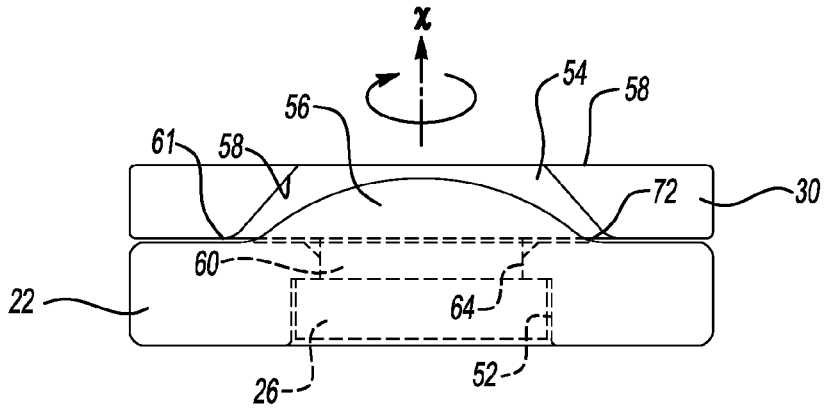
FIG. 8A shows the magnet, the insert, and the metallic plate in an installed position.
Figure 8B:
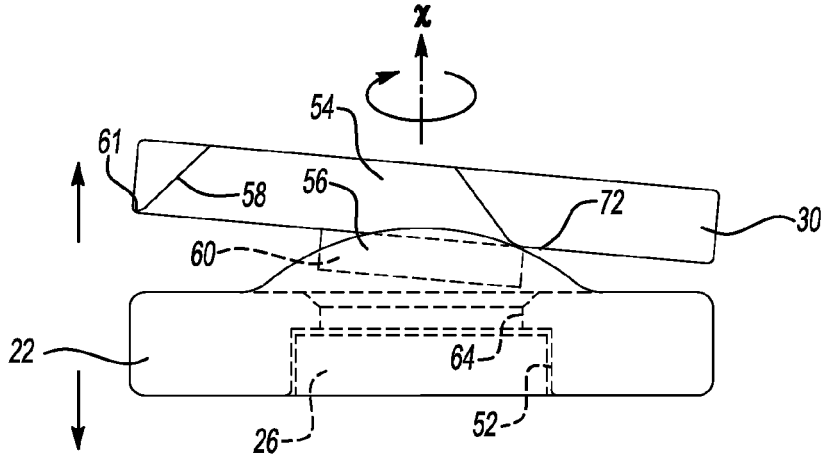
FIG. 8B shows the magnet, the insert, and the metallic plate in an uninstalled position.
Figure 8C:
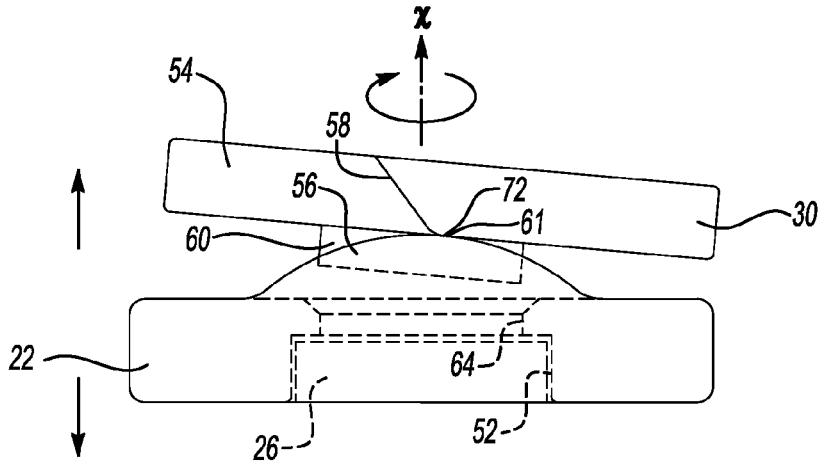
FIG. 8C shows the magnet, the insert, and the metallic plate in another uninstalled position.

Referring now to FIGS. 8A-8C with continuing reference to FIG. 1, the metallic plate 30 includes an extension 60, which, in the installed position, is received within an aperture 64 defined by the knob insert 22 such that the extension 60 contacts the magnet 26 through the aperture 64 in the knob insert 22. As described above, the knob insert 22 is secured relative to the knob 14 to limit movement of the magnet 26 away from the knob 14. Accordingly, in the installed position, the magnet 26 holds the cover 18 against the knob 14 through the extension 60 of the metallic plate 30.

The cam 56 extends within the notch 54 when the pull assembly 10 is in the installed position. In this example, the edges of the metallic plate 30 defining the notch 54 contact the cam 56 at point 72 when the metallic plate 30 rotates about the axis X. Rotating the metallic plate 30 urges the metallic plate 30 further from the knob insert 22 as the point 72 moves further along the cam 56 to the position shown in FIG. 8C. Moving the point 72 to this position on the cam 56 moves the extension 60 away from the magnet 26 to an uninstalled position.

Other examples arrangements suitable for moving the pull assembly 10 from the installed position to the uninstalled position include extending the cam 56 from the metallic plate 30 and received the cam 56 within a notch defined by the knob insert 22. Those skilled in the art and having the benefit of this disclosure would be able to develop still other configurations for separating the metallic plate 30 from the magnet 26.

The user rotates the example cover 18 about the axis X to rotate the metallic plate 30 relative the knob 14 and the knob insert 22. The divots 68 within the example cover 18 may help the user to grasp and rotate the cover 18. As described above, moving the cover 18 away from the knob 14 causes the extension 60 of the metallic plate 30 to move away from the magnet 26 held by the knob insert 22 within the knob 14. Moving the metallic plate 30 away from the magnet 26 severs the magnetic bond holding the cover 18 in the installed position against the knob 14. Accordingly, the user, by rotating the cover 18, is able to move the cover 18 to an uninstalled position, axially further from the knob 14 than the installed position.

Moving the cover 18 to an uninstalled position allows the user to install a different cover 18 within the second recessed area 46. The magnet 26 holds the new cover (not shown) within the second recessed area 46 just as the cover 18. In this example, the magnet 26 that attracts the extension 60 of the metallic plate is a rare earth magnet capable of exerting 6-9 pounds of force holding the cover 18 within the second recessed area 46. That is, 6-9 pounds of force are required to separate the extension 60 from the magnet 26.

Figure 9:
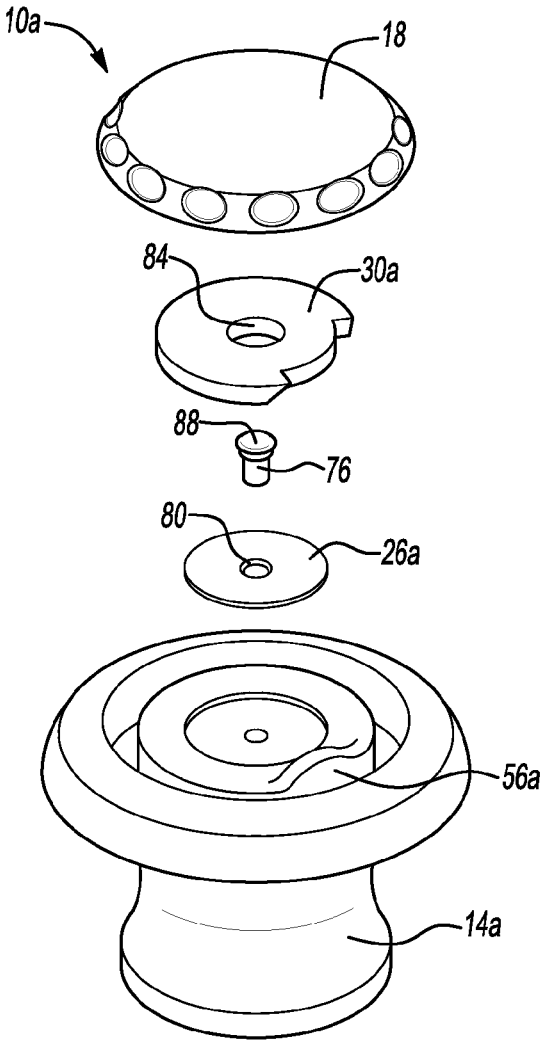
FIG. 9 shows an exploded view of another example pull assembly.

Referring now to the exploded view of FIG. 9, another example pull assembly 10*a* includes a knob portion 14*a* having a molded cam portion 56*a*. The knob portion 14*a* is die cast or injection molded, for example, and the cam portion 56*a* is formed during the casting or molding process.

A magnet 26*a* is secured directly to the knob portion 14*a* using a rivet 76. As the example pull assembly 10*a* does not include the knob insert 22 (FIG. 1) for holding the magnet 26*a*, the rivet 76 extends through a magnet aperture 80 to secure the magnet 26*a* relative to the knob portion 14*a*. A metallic plate 30*a* includes a plate aperture 84, which provides clearance for a rivet head 88 when the pull assembly 10*a* is in an assembled position.

Figure 10:
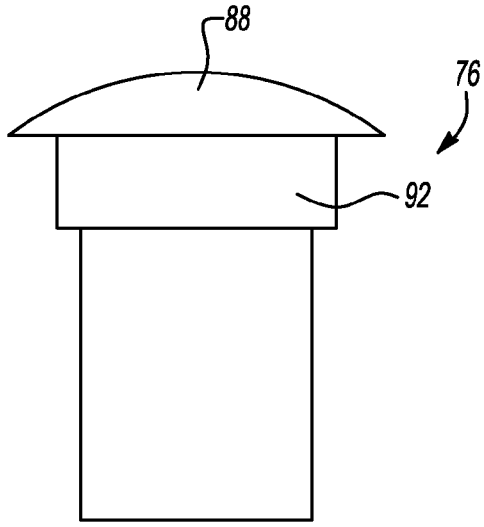
FIG. 10 shows a side view of the rivet in the FIG. 9 assembly.

Referring to FIG. 10 with continuing reference to FIG. 9, the example rivet 76 includes a shouldered area 92, which is received within the magnet aperture 80 when the pull assembly 10*a* is in the assembled position. The diameter of the shouldered area 92 is smaller than the diameter of the magnet aperture 80 to permit some axial movement of magnet 26*a* relative the knob 14*a* when the pull assembly 10*a* is in the assembled position.

Although a preferred embodiment has been disclosed, a worker of ordinary skill in this art would recognize that certain modifications would come within the scope of this invention. For that reason, the following claims should be studied to determine the true scope and content of this invention.

We claim:

1. A pull assembly, comprising:

a knob defining an axis;

a cover moveable between an installed position adjacent said knob and an uninstalled position further from said knob than the installed position;

a magnet holding said cover in the installed position; and a cam extending from at least one of said cover and said knob, wherein said cam urges said cover from the installed position to the uninstalled position when said cover is rotated whereby said cam extending from said at least one of said cover and said knob engages an other of said cover and said knob while said cover is rotated to uninstall said cover from the installed position.

2. The pull assembly of claim 1, wherein said cover comprises a metallic plate portion attractable to said magnet.

3. The pull assembly of claim 2, wherein said metallic plate portion defines a notch that receives said cam when said cover is in the installed position.

4. The pull assembly of claim 1, wherein said knob comprises a knob insert portion for holding said magnet.

5. The pull assembly of claim 4, wherein said cam extends from said knob insert portion.

6. The pull assembly of claim 4, wherein said knob defines a notch for receiving said cam.

7. The pull assembly of claim 1, wherein said cam is received within a notch defined by said cover.

8. The pull assembly of claim 1, wherein said cover moves from the installed position to the uninstalled position in response to relative rotational movement of said cam about the axis.

9. The pull assembly of claim 1, wherein said knob is attachable to a cabinet.

10. The pull assembly of claim 1 wherein said magnet is disposed in said knob.

11. A pull assembly, comprising:

a knob defining an axis;

a cover moveable between an installed position adjacent said knob and an uninstalled position further from said knob than the installed position;

a magnet holding said cover in the installed position; and a cam extending from at least one of said cover and said knob, wherein said cam urges said cover from the installed position to the uninstalled position when said cover is rotated whereby said cam extending from said at least one of said cover and said knob engages an other of said cover and said knob while said cover is rotated to uninstall said cover from the installed position wherein said cover comprises a metallic plate portion attractable to said magnet and wherein said metallic plate portion defines a notch that receives said cam when said cover is in the installed position.

* * * * *